US008878885B2

(12) United States Patent
Miyadera

(10) Patent No.: US 8,878,885 B2
(45) Date of Patent: Nov. 4, 2014

(54) IMAGE FORMING APPARATUS AND IMAGE FORMING METHOD

(71) Applicant: Tatsuya Miyadera, Kanagawa (JP)

(72) Inventor: Tatsuya Miyadera, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/076,339

(22) Filed: Nov. 11, 2013

(65) Prior Publication Data

US 2014/0146120 A1 May 29, 2014

(30) Foreign Application Priority Data

Nov. 27, 2012 (JP) ..... 2012-258674

(51) Int. Cl.

| | |
|---|---|
| ***B41J 2/385*** | (2006.01) |
| ***B41J 2/435*** | (2006.01) |
| ***B41J 2/47*** | (2006.01) |
| ***G03G 15/01*** | (2006.01) |

(52) U.S. Cl.

CPC ..... *G03G 15/01* (2013.01)
USPC ..... 347/234; 347/116; 347/229; 347/248

(58) Field of Classification Search

CPC ..... G03G 15/1695; G03G 2215/00966; G03G 2215/00405; G06K 15/1219; B41J 13/03; B41J 13/08
USPC ..... 347/116, 229, 234, 248, 249; 271/227, 271/265.01

See application file for complete search history.

(56) References Cited

U.S. PATENT DOCUMENTS

| | | | | |
|---|---|---|---|---|
| 6,553,206 | B2 * | 4/2003 | Asuwa et al. | 399/384 |
| 2006/0176354 | A1 | 8/2006 | Yoshida | |
| 2008/0166153 | A1 | 7/2008 | Ehara et al. | |
| 2009/0208229 | A1 * | 8/2009 | Takagi et al. | 399/43 |
| 2010/0239331 | A1 | 9/2010 | Miyadera et al. | |
| 2011/0026082 | A1 | 2/2011 | Miyadera et al. | |
| 2011/0085827 | A1 * | 4/2011 | Tominaga et al. | 399/301 |
| 2012/0288291 | A1 | 11/2012 | Miyadera | |
| 2013/0070040 | A1 | 3/2013 | Miyadera et al. | |

FOREIGN PATENT DOCUMENTS

| | | |
|---|---|---|
| JP | 2001-265090 | 9/2001 |
| JP | 2004-069949 | 3/2004 |
| JP | 2006-189739 | 7/2006 |
| JP | 2009-058918 | 3/2009 |
| JP | 2010-244029 | 10/2010 |
| JP | 4815334 | 9/2011 |
| JP | 2013-064811 | 4/2013 |
| JP | 2013-220576 A | 10/2013 |
| JP | 2014-010402 A | 1/2014 |
| JP | 2014-024276 A | 2/2014 |

* cited by examiner

*Primary Examiner* — Hai C Pham

(74) *Attorney, Agent, or Firm* — Oblon, Spivak, McClelland, Maier & Neustadt, L.L.P.

(57) ABSTRACT

An image forming apparatus includes a sheet-linear-velocity setting unit, an image-formation-rate changing unit, a detecting unit, and first and second correcting units. When printing is performed with a first sheet linear velocity, the first correcting unit performs misregistration correction according to a result of detection of a misregistration correction pattern image by the detecting unit. When the sheet-linear-velocity setting unit sets a second sheet linear velocity other than the first sheet linear velocity, the second correcting unit corrects an adjustment amount used in the misregistration correction performed by the first correcting unit, according to a ratio between first and second coefficients. The first coefficient indicates a ratio of an actual image formation rate at the first sheet linear velocity to an ideal image formation rate, and the second coefficient indicates a ratio of an actual image formation rate at the second sheet linear velocity to an ideal image formation rate.

12 Claims, 9 Drawing Sheets

| SETTING | SHEET LINEAR VELOCITY | LINE PERIOD | ACTUAL IMAGE FORMATION RATE | IDEAL VALUE OF IMAGE FORMATION RATE (CLOCK NUMBER) | LINEAR-VELOCITY ADJUSTMENT FACTOR ($\alpha$h/$\alpha$m/$\alpha$l) |
|---|---|---|---|---|---|
| 1st SPEED | 144mm/sec | 73.50us | SP1 | 4335 | $\alpha$h=(SP1)/4335 |
| MEDIUM SPEED | 90mm/sec | 117.59us | SP2 | 6936 | $\alpha$m=(SP2)/6936 |
| LOW SPEED | 60mm/sec | 176.39us | SP3 | 10404 | $\alpha$l=(SP3)/10404 |

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2012-258674 filed in Japan on Nov. 27, 2012.

BACKGROUND OF THE INVENTION

1. Field of the Invention

The present invention relates to an image forming apparatus and an image forming method.

2. Description of the Related Art

As a method an electrophotographic image forming apparatus corrects, for example, a misregistration among transferred images in respective colors (sometimes referred to as "color shift"), there is known a method to form a misregistration correction pattern on a conveyance belt on which a recording medium such as a sheet of paper is conveyed or an image carrier such as an intermediate transfer body, and detect position information of the misregistration correction pattern formed on the conveyance belt or the image carrier by means of a sensor, and then correct misregistration on the basis of the detected position information. For example, Japanese Patent No. 4815334 discloses a technology for correction of misregistration by forming and detecting a speed fluctuation pattern of rotation speed of each of multiple photoreceptors.

However, the technology disclosed in Japanese Patent No. 4815334 has a problem that user down-time occurs due to the formation/detection of multiple speed fluctuation patterns. Therefore, there is a need for an image forming apparatus and image forming method capable of suppressing deterioration of the image quality while suppressing the user down-time.

SUMMARY OF THE INVENTION

According to an embodiment, an image forming apparatus includes an exposure unit, a sheet-linear-velocity setting unit, an image-formation-rate changing unit, a detecting unit, a first correcting unit, and a second correcting unit. The exposure unit is configured to perform exposure depending on image data thereby forming a latent image based on the image data on a photoreceptor. The sheet-linear-velocity setting unit is configured to variably set, according to a type of a sheet used in printing, a sheet linear velocity indicating speed at which the sheet is conveyed. The image-formation-rate changing unit is configured to change, according to the sheet linear velocity set by the sheet-linear-velocity setting unit, an image formation rate indicating a cycle of image formation of the exposure unit. The detecting unit is configured to detect a misregistration correction pattern image formed on an image carrier driven at predetermined speed. The first correcting unit is configured to correct, when printing is performed with a first sheet linear velocity indicating a reference sheet linear velocity, misregistration according to a result of detection of the misregistration correction pattern image by the detecting unit. The second correcting unit is configured to correct, when the sheet-linear-velocity setting unit sets a second sheet linear velocity indicating a sheet linear velocity other than the first sheet linear velocity, an adjustment amount which has been used in the misregistration correction performed by the first correcting unit, according to a ratio between a first coefficient and a second coefficient. The first coefficient indicates a ratio of an actual image formation rate at the first sheet linear velocity to an ideal image formation rate. The second coefficient indicates a ratio of an actual image formation rate at the second sheet linear velocity to an ideal image formation rate.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of an image forming apparatus and image forming method according to the present invention will be explained in detail below with reference to accompanying drawings. The image forming apparatus according to the present invention can be applied to any devices that form an image by using an electrophotographic system; for example, the present invention can be applied to an electrophotographic image forming apparatus or multifunction peripheral (MFP), etc. Incidentally, the MFP is a device having at least two functions out of a print function, a copy function, a scanner function, and a facsimile function.

Figure 1:
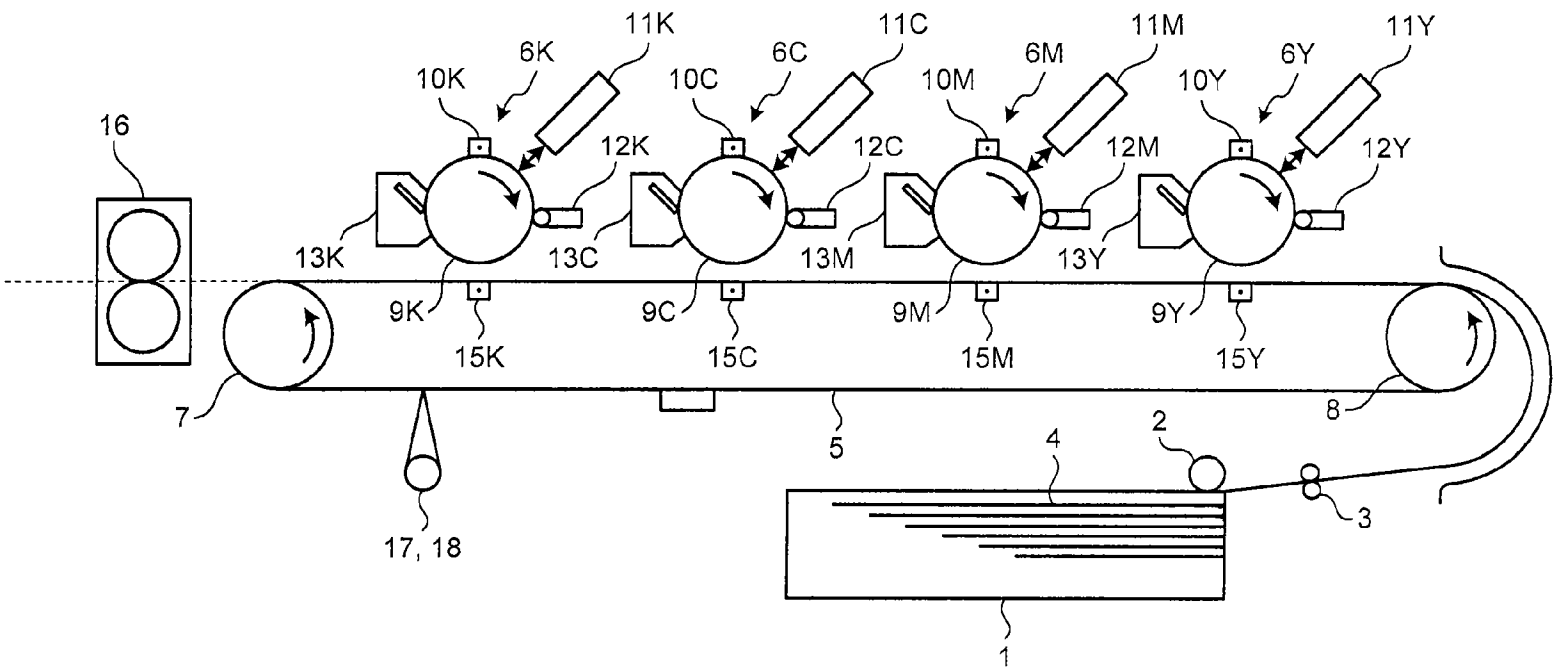
FIG. 1 is a diagram showing a configuration example of a general electrophotographic device with a focus on an image forming section.

FIG. 1 is a diagram showing a configuration example of a general electrophotographic device with a focus on an image forming section. The electrophotographic device shown in FIG. 1 has a configuration that an image forming unit (electrophotographic processing unit) 6C for forming a cyan (C) image, an image forming unit 6M for forming a magenta (M) image, an image forming unit 6Y for forming a yellow (Y) image, and an image forming unit 6K for forming a black ("K" or sometimes referred to as "Bk") image are arranged along a conveyance belt 5 which is an endless moving body, and is a so-called tandem type. In the following description, the image forming units 6Y, 6M, 6C, and 6K may be referred to simply as the "image forming unit 6" if there is no distinction made among them. The electrophotographic device shown in FIG. 1 adopts a direct transfer method in which an image formed on a photosensitive drum by exposure of the photosensitive drum to a light depending on image data is directly transferred onto a recording medium such as a sheet of paper.

As shown in FIG. 1, in order of the upstream side in a conveying direction of the conveyance belt 5, the multiple image forming units 6Y, 6M, 6C, and 6K are arranged along the conveyance belt 5 onto which a sheet 4 picked up from a paper sheet tray 1 is fed one by one by a feed roller 2 and a separation roller 3 is conveyed. These image forming units 6Y, 6M, 6C, and 6K have the same internal configuration except for color of a toner image formed. Here we provide concrete description of the image forming unit 6Y; however, the other image forming units 6M, 6C, and 6K have the same configuration as the image forming unit 6Y, so we leave out the explanation of components of the image forming units 6M, 6C, and 6K, and just depict the components numbered with the same reference numerals as those of the image forming unit 6Y but the trailing alpha-numeral "Y" is changed to "M", "C", and "K".

The conveyance belt 5 is an endless belt supported by a drive roller 7 which is driven to rotate and a driven roller 8. The drive roller 7 is driven to rotate by a drive motor (not shown), and the drive motor, the drive roller 7, and the driven roller 8 serve as a drive means for driving the conveyance belt 5 which is an endless moving means. In image formation, the top sheet of sheets 4 contained in the paper sheet tray 1 is sequentially fed, and adheres to the conveyance belt 5 by electrostatic adhesion action and is conveyed to the first image forming unit 6Y in accordance with the rotation of the conveyance belt 5, and then a yellow toner image is transferred onto the sheet 4 in the image forming unit 6Y.

As shown in FIG. 1, the image forming unit 6Y includes a photosensitive drum 9Y as a photoreceptor, and a charger 10Y, an LEDA head 11Y, a developing unit 12Y, a photoreceptor cleaner (not shown), and a static eliminator 13Y which are arranged around the photosensitive drum 9Y. The LEDA head 11Y exposes the photosensitive drum 9Y.

In image formation, after the outer circumferential surface of the photosensitive drum 9Y is uniformly charged by the charger 10Y in the dark, the uniformly-charged photosensitive drum 9Y is exposed to an irradiation light depending on a yellow image which is emitted from the LEDA head 11Y, and an electrostatic latent image is formed on the surface of the photosensitive drum 9Y. The developing unit 12Y develops the electrostatic latent image into a visible image by the application of yellow toner. As a result, a yellow toner image is formed on the photosensitive drum 9Y. The yellow toner image formed on the photosensitive drum 9Y is transferred onto the sheet 4 at the point of contact between the photosensitive drum 9Y and the sheet 4 on the conveyance belt 5 (a transfer position) by the action of a transfer unit 15Y. Through the transfer, the yellow toner image is formed on the sheet 4. After the transfer of the toner image, the photoreceptor cleaner wipes off residual toner remaining on the outer circumferential surface of is the photosensitive drum 9Y, and the static eliminator 13Y eliminates static electricity from the photosensitive drum 9Y to make the photosensitive drum 9Y stand by for the next image formation.

The sheet 4 onto which the yellow toner image has been transferred in the image forming unit 6Y as described above is conveyed to the next image forming unit 6M in accordance with the rotation of the conveyance belt 5. In the image forming unit 6M, a magenta toner image is formed on a photosensitive drum 9M through the same image forming process as in the image forming unit 6Y, and the magenta toner image is transferred onto the sheet 4 so as to be superimposed on the yellow toner image formed on the sheet 4. The sheet 4 is further conveyed to the next image forming units 6C and 6K in the same way, and a cyan toner image formed on a photosensitive drum 9C and a black toner image formed on a photosensitive drum 9K are sequentially transferred onto the sheet 4 in a superimposed manner. Thus, a full-color image is formed on the sheet 4. Namely, in the example shown in FIG. 1, the image forming unit 6 forms a full-color image on a recording medium (the sheet 4) driven at predetermined speed by superimposing multiple different color images. The sheet 4 on which the full-color superimposed image has been formed comes off the conveyance belt 5, and is fed into a fuser 16. The fuser 16 applies heat and pressure to the sheet 4, thereby fixing the superimposed image on the sheet 4. The sheet 4 on which the image has been fixed is discharged to the outside of the electrophotographic device.

In the electrophotographic image forming apparatus as described above, if the transfer position of each color is shifted, toner images are not superimposed properly, and the image quality of a printed image is degraded. Therefore, it is necessary to correct the misalignment of the transfer position of each color (it is necessary to correct misregistration of the toner images). To correct the misregistration, the electrophotographic device shown in FIG. 1 forms a misregistration correction pattern image on the conveyance belt 5 on which the sheet 4 is transferred. Sensors 17 and 18 for detecting a misregistration correction pattern image formed on the conveyance belt 5 are installed on the downstream side of the photosensitive drums (9Y, 9M, 9C, and 9K) (the downstream side of the conveyance belt 5 in a driving direction).

Each of the sensors 17 and 18 is composed of a light reflective sensor, such as a TM sensor, and includes a light source which emits a light beam toward an object to be detected and a light detecting element which detects a reflected light from the object to be detected. In the example shown in FIG. 1, the sensors 17 and 18 are arranged to be aligned in a direction perpendicular to the driving direction (conveying direction, sub-scanning direction) of the conveyance belt 5 (i.e., in a main scanning direction). Incidentally, in the example shown in FIG. 1, two sensors (17 and 18) are arranged along the main scanning direction; however, the number and location of sensors for detecting a misregistration correction pattern image can be arbitrarily changed.

Figure 2:
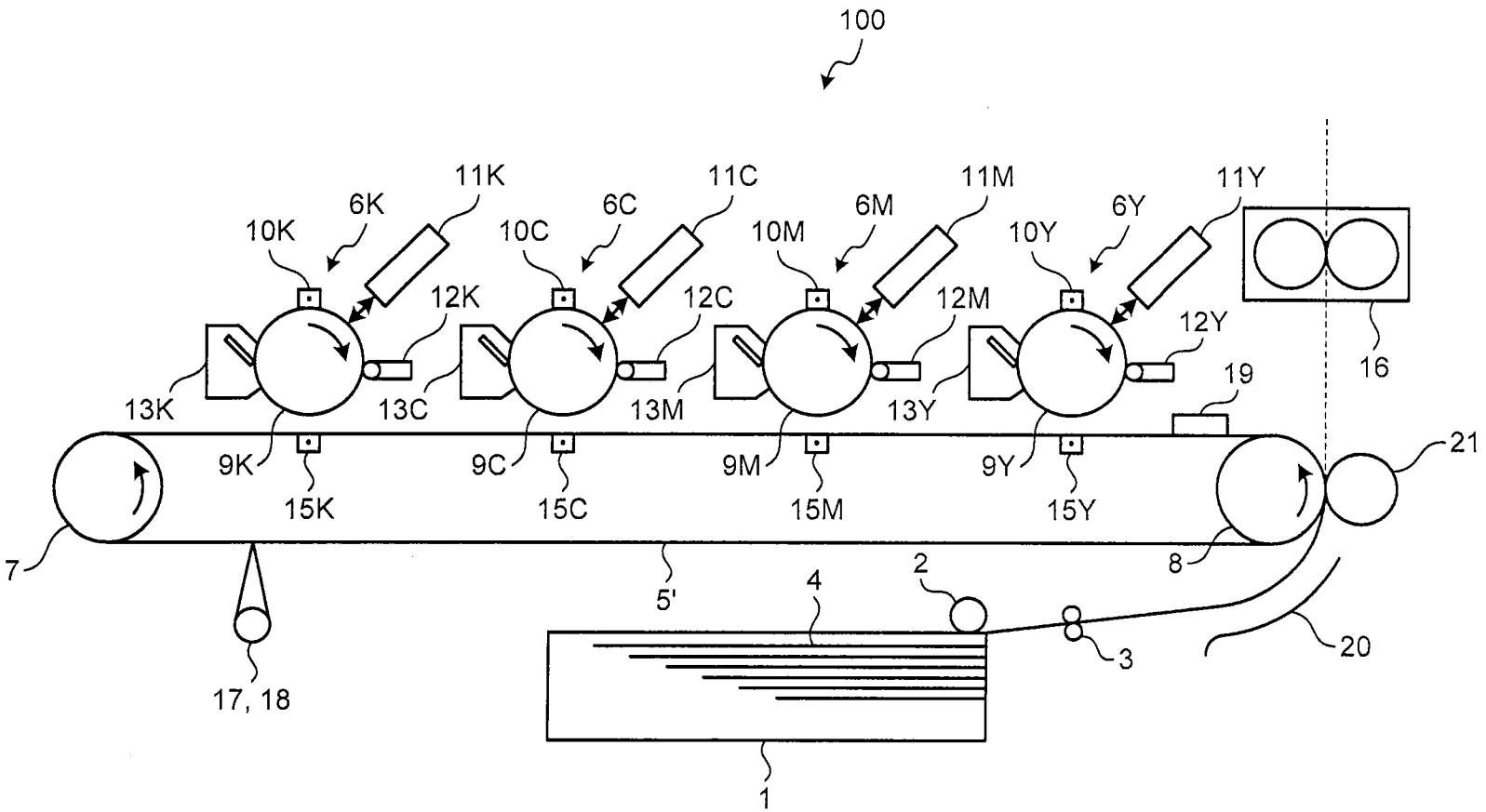
FIG. 2 is a diagram showing a configuration example of an image forming apparatus according to a present embodiment with a focus on an image forming section.

The electrophotographic device illustrated in FIG. 1 is a type of device that directly transfers an image onto a recording medium, whereas an image forming apparatus 100 illustrated in FIG. 2 is a type of device that transfers a toner image formed on an intermediate transfer belt 5' onto a recording medium such as a sheet 4. An image forming apparatus according to the present embodiment is explained by taking an indirect transfer type of image forming apparatus, such as the image forming apparatus 100 shown in FIG. 2 which transfers a toner image formed on the intermediate transfer belt 5' onto a recording medium such as a sheet 4, as an example. However, the image forming apparatus according to the present embodiment is not limited to this, and can be applied to a direct transfer type of image forming apparatus which directly transfers an image onto a recording medium, such as that shown in FIG. 1.

In the example shown in FIG. 2, an endless moving means is not a conveyance belt 5 but the intermediate transfer belt 5'. The intermediate transfer belt 5' is an endless belt supported by the drive roller 7 which is driven to rotate and the driven roller 8. Y, M, C, and K toner images are sequentially transferred onto the intermediate transfer belt 5' by the action of the transfer units 15Y, 15M, 15C, and 15K at the point where the photosensitive drums 9Y, 9M, 9C, and 9K have contact with the intermediate transfer belt 5' (primary transfer position). Through the transfer, a full-color image that Y, M, C, and K toner images are superimposed is formed on the intermediate transfer belt 5'. Namely, in the example shown in FIG. 2, the image forming unit 6 forms a full-color image on an image carrier (the intermediate transfer belt 5') driven at predetermined speed by superimposing multiple different color images. In image formation, the top sheet of sheets 4 contained in the paper sheet tray 1 is sequentially fed onto the intermediate transfer belt 5'. The full-color toner image formed on the intermediate transfer belt 5' is transferred onto the sheet 4 at the point of contact between the intermediate transfer belt 5' and the sheet 4 (a secondary transfer position 20) by the action of a secondary transfer roller 21. The secondary transfer roller 21 is in close contact with the intermediate transfer belt 5', and does not have a mechanism for moving closer to or away from the intermediate transfer belt 5'. In this manner, a full-color image is formed on the sheet 4. The sheet 4 on which the full-color superimposed image has been formed is fed into the fuser 16, and the image is fixed on the sheet 4 by the fuser 16, and then the sheet 4 is discharged to the outside of the image forming apparatus 100.

In the example shown in FIG. 2, to correct misregistration, a misregistration correction pattern image is formed on the intermediate transfer belt 5' which is an Image carrier. The sensors 17 and 18 for detecting the misregistration correction pattern image formed on the intermediate transfer belt 5' are disposed on the downstream side of the photosensitive drums (9Y, 9M, 9C, and 9K) (the downstream side of the conveyance belt 5 in the driving direction).

Figure 3:
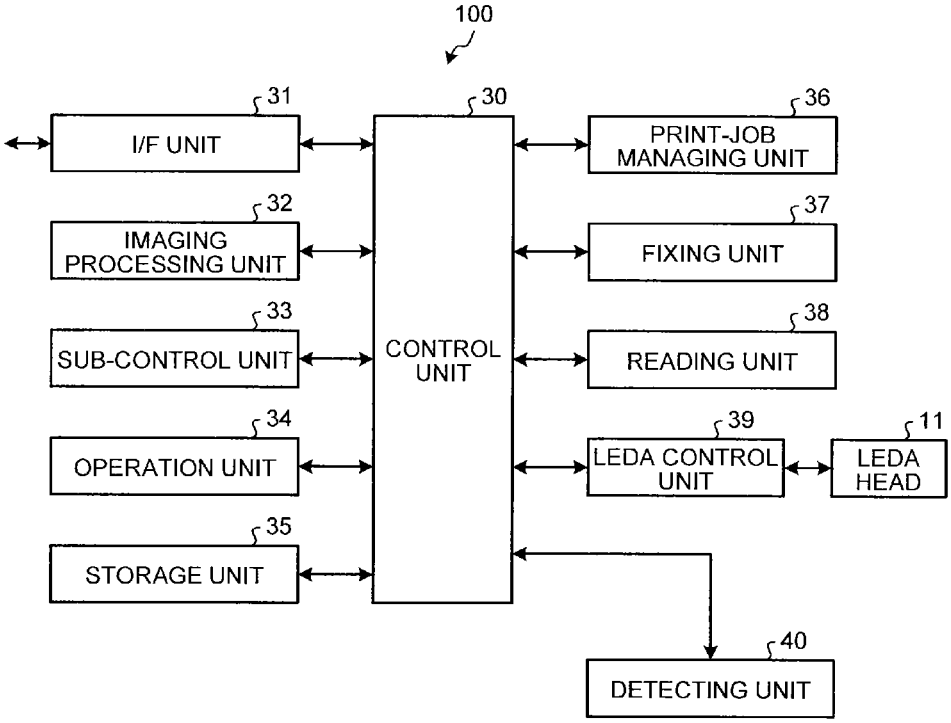
FIG. 3 is a functional block diagram showing an example of a configuration for controlling the image forming apparatus according to the present embodiment.

FIG. 3 is a functional block diagram showing an example of a configuration for controlling the image forming apparatus 100 according to the present embodiment. As shown in FIG. 3, the image forming apparatus 100 includes a control unit 30, an interface (I/F) unit 31, an imaging processing unit 32, a sub-control unit 33, an operation unit 34, a storage unit 35, a print-job managing unit 36, a fixing unit 37, a reading unit 38, an LEDA control unit 39, and a detecting unit 40.

The control unit 30 includes, for example, a central processing unit (CPU), a read-only memory (ROM), and a random access memory (RAM), and controls the entire image forming apparatus 100 in accordance with a program preliminarily stored in the ROM by using the RAM as a work memory. Furthermore, the control unit 30 includes an arbitrating unit that performs arbitration of data transfer on a bus, and controls data transfer between the units.

The I/F unit 31 is connected to an external device such as a personal computer (PC), and controls communication with the external device in accordance with an instruction from the control unit 30. For example, the I/F unit 31 receives a print request transmitted from the external device, and passes the received print request to the control unit 30. The print-job managing unit 36 manages the order of execution of print requests (print jobs) issued to the image forming apparatus 100.

The sub-control unit 33 includes, for example, a CPU, and controls the units shown in FIG. 2 in response to a print request and passes image data to be printed, which has been transmitted from the external device via the I/F unit 31, to the LEDA control unit 39.

The LEDA control unit 39 forms a latent image based on image data on the photosensitive drum 9 by exposure of the photosensitive drum 9 to a light depending on image data. More specifically, the LEDA control unit 39 receives image data from the sub-control unit 33, and controls writing of light based on the image data on the photosensitive drums 9Y, 9M, 9C, and 9K, i.e., causes the LEDA heads 11Y, 11M, 11C, and 11K to expose the photosensitive drums 9Y, 9M, 9C, and 9K to light based on the image data. In the following description, the LEDA heads 11Y, 11M, 11C, and 11K may be referred to simply as the "LEDA head 11" if there is no distinction made among them. The LEDA head 11 is connected to the LEDA control unit 39. In this example, it can be considered that the LEDA control unit 39 and the LEDA head 11 correspond to an "exposure unit" in claims.

The imaging processing unit 32 includes the image forming units 6Y, 6M, 6C, and 6K, and performs image development and transfer, etc. of electrostatic latent images written on the photosensitive drums 9Y, 9M, 9C, and 9K by the LEDA control unit 39.

The detecting unit 40 includes the sensors 17 and 18, and detects the misregistration correction pattern image formed on the intermediate transfer belt 5' by the image forming unit 6 on the basis of signals output from the sensors 17 and 18.

The storage unit 35 stores therein information on the state of the image forming apparatus 100 at a certain point of time. For example, a result of detection of the misregistration correction pattern image by the detecting unit 40 is stored in the storage unit 35. The control unit 30 controls a misregistration correcting process performed by the LEDA control unit 39 on the basis of the acquired detection result. The operation unit 34 includes a manipulandum for receiving user operation and a display unit for displaying the state of the image forming apparatus 100 to a user.

The fixing unit 37 includes the fuser 16 and a control unit for controlling the fuser 16, and applies heat and pressure to a sheet 4 onto which a toner image has been transferred by the imaging processing unit 32, thereby fixing the toner image on the sheet 4.

The reading unit 38 reads printing information on the sheet 4 and converts the read printing information into an electrical signal, and realizes a so-called scanner function. The reading unit 38 outputs the electrical signal to the control unit 30. This reading unit 38 and a communication means (not shown) enable the image forming apparatus 100 to work as an MFP that realizes a printer function, a scanner function, a copy function, and a FAX function within one enclosure. Incidentally, the reading unit 38 is optional.

Figure 4:
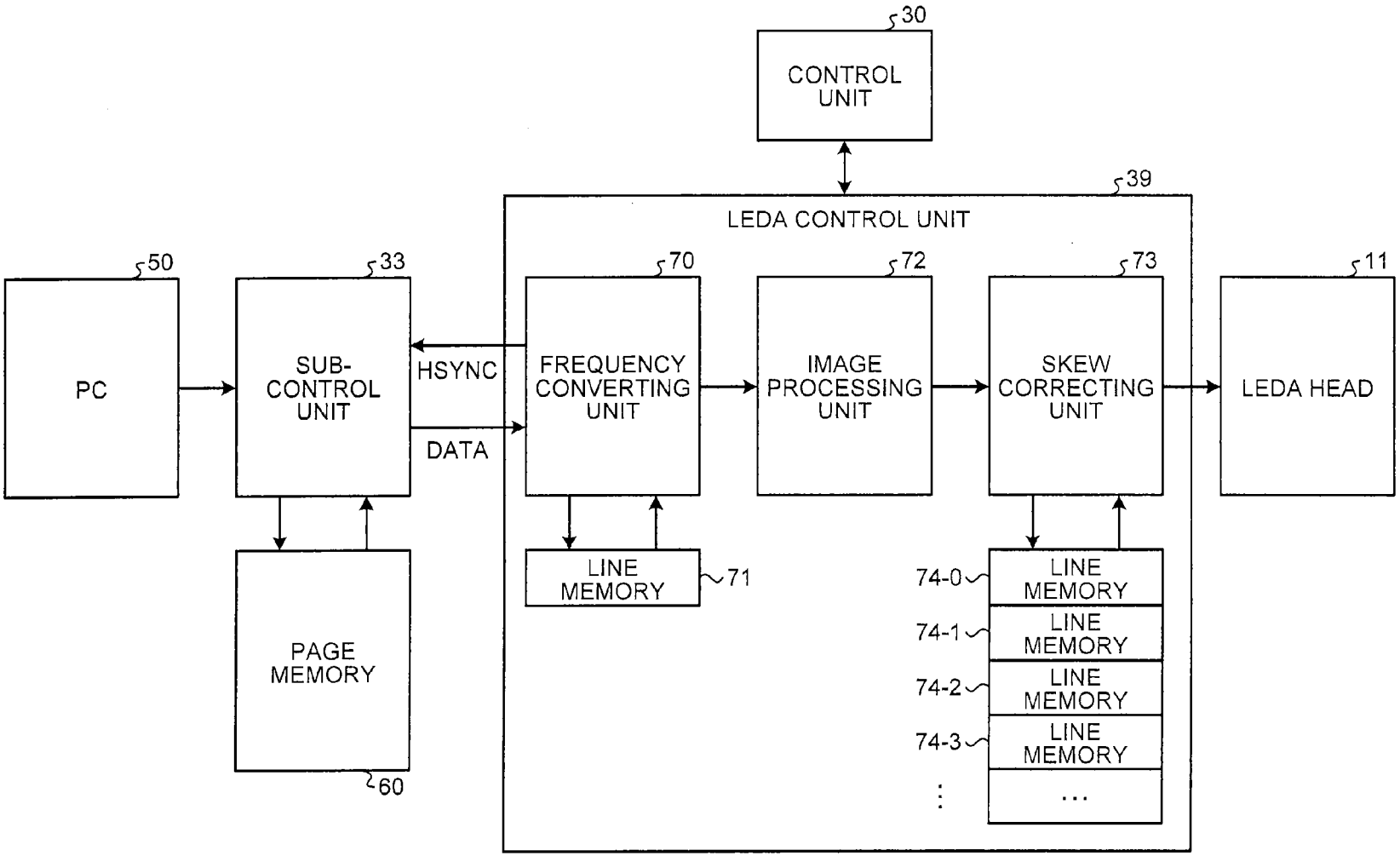
FIG. 4 is a diagram for explaining an example of detailed functions of an LEDA control unit.

FIG. 4 is a diagram for explaining an example of detailed functions of the LEDA control unit 39. The sub-control unit 33 receives print data generated by a PC 50 (a printer driver installed in the PC 50) via a network (not shown). The print data is described in, for example, page description language (PDL) or the like. Then, the sub-control unit 33 converts the received print data into image data (for example, bitmap data) composed of multiple pixels on a page memory 60, and transfers the image data to the LEDA control unit 39 on a line-by-line basis. More specifically, the sub-control unit 33 transfers the image data to the LEDA control unit 39 at the timing at which an HSYNC signal is output from the LEDA control unit 39 to the sub-control unit 33. As the transfer method, there are two methods: an image forming method capable of processing formats which differ among multiple channels (CH) and an image forming method for processing only a common format among the channels.

On the basis of the line-by-line image data transferred from the sub-control unit 33, the LEDA control unit 39 causes the LEDA head 11 to emit a light to form an electrostatic latent image. Namely, the LEDA control unit 39 treats the image data transferred from the sub-control unit 33 as light emitting data. The LEDA control unit 39 includes a frequency converting unit 70, a line memory 71, an image processing unit 72, a skew correcting unit 73, and line memories 74-0 to 74-I (I is a natural number more than one).

The sub-control unit 33 and the LEDA control unit 39 differ in operation clock frequency. Therefore, the frequency converting unit 70 sequentially records the line-by-line image data transferred from the sub-control unit 33 on the line memory 71, and sequentially reads out the recorded line-by-line image data on the basis of an operation clock of the LEDA control unit 39 and performs frequency conversion on the read line-by-line image data, and then transfers the converted line-by-line image data to the image processing unit 72.

The image processing unit 72 performs image processing on the line-by-line image data transferred from the frequency converting unit 70, and transfers the processed line-by-line image data to the skew correcting unit 73. The image processing includes, for example, an internal pattern adding process and trimming, etc. Furthermore, under the control of the control unit 30, the image processing unit 72 performs misregistration correction depending on a unit of input resolution in parallel with the image processing. Incidentally, for example, in the case where a process requiring a line memory, such as jaggy correction, is performed as the image processing, the LEDA control unit 39 shall include a line memory for the image processing unit 72. As well as performing the image processing on the image data received from the PC 50, the image processing unit 72 can generate predetermined image data (for example, image data of a misregistration correction pattern image) in accordance with an instruction from the control unit 30.

The skew correcting unit 73 sequentially records the line-by-line image data transferred from the image processing unit 72 on the line memories 74-0 to 74-I, and sequentially reads out the recorded line-by-line image data by switching to the line memory 74 from which image data is to be read among the line memories 74-0 to 74-I according to the image position and performs skew correction on the read line-by-line image data, and then transfers the corrected line-by-line image data to the LEDA head 11.

The line period at the time when the skew correcting unit 73 reads the image data is 1/N (N is a natural number) of the line period at the time when the skew correcting unit 73 writes the image data. When the skew correcting unit 73 reads out the image data from the line memories 74-0 to 74-I, the skew correcting unit 73 performs a density multiplying process for increasing the resolution of the image data in the sub-scanning direction by a factor of N by reading out the same image data from one line memory 74 N times consecutively. The data having been subjected to the skew correction and the density multiplying process is transferred to the LEDA head 11. The control unit 30 adjusts an image formation rate by changing the data transfer rate at that time. The image formation rate is the pace of image formation; more specifically, the image formation rate means the pace of forming an electrostatic latent image on the photosensitive drum 9 (the light writing speed of the LEDA control unit 39). The image formation rate can also be considered to indicate the light emission cycle (the image formation cycle) of the LEDA head 11.

Depending on a type of the LEDA head 11, a data sequence needs to be converted according to the layout of the LEDA head 11; therefore, if the sequence conversion is required over the entire line, the LEDA control unit 39 shall include a line memory for sequence conversion. Then, the sequence of image data having been subjected to skew correction is converted on this line memory, and the line-by-line image data is transferred to the LEDA head 11.

The LEDA head 11 emits a light on the basis of line-by-line image data transferred from the skew correcting unit 73 to form an electrostatic latent image on the photosensitive drum 9. In the present embodiment, the density multiplying process is performed by the skew correcting unit 73; therefore, the LEDA head 11 can form an electrostatic latent image with the resolution of the image data in the sub-scanning direction increased to higher density, so that it is possible to perform the fine gradation control and registration control. Furthermore, in the present embodiment, the timing at which the LEDA head 11 starts the light emission is delayed by one clock unit with each color; therefore, it is possible to perform the ultra-high accuracy registration control in less than one line unit.

Figure 5:
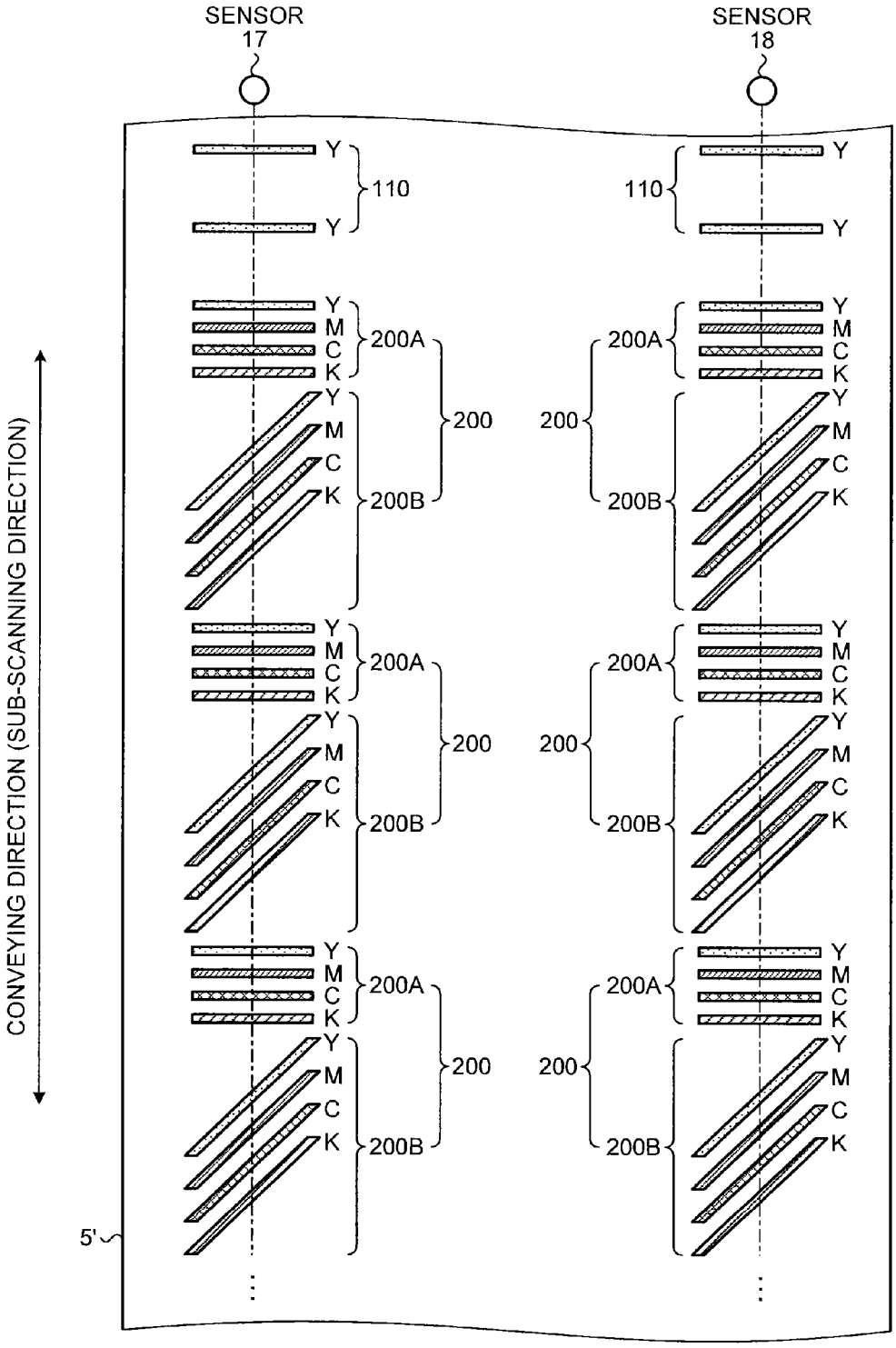
FIG. 5 is a diagram showing an example of a misregistration correction pattern image for color images.

FIG. 5 is a diagram showing an example of a misregistration correction pattern image for color images. In the present embodiment, under the control of the control unit 30, the image forming unit 6 forms a misregistration correction pattern image for color images on the intermediate transfer belt 5' driven at predetermined speed. More specifically, the image forming unit 6 forms a plurality of ladder patterns 200 as illustrated in FIG. 5 on the intermediate transfer belt 5' (an example of an image carrier) driven at predetermined speed. Each of the ladder patterns 200 is composed of a combination of a horizontal line pattern 200A and a diagonal line pattern 200B; the horizontal line pattern 200A is composed of Y, M, C, and K-color lines extending parallel to the main scanning direction which are placed at equal spaces along the sub-scanning direction, and the diagonal line pattern 200B is composed of Y, M, C, and K-color lines extending at a 45-degree angle to the sub-scanning direction which are placed at equal spaces along the sub-scanning direction. Hereinafter, the Y, M, C, and K-color lines composing each ladder pattern 200 may be referred to as toner marks. Namely, it can be considered that each ladder pattern 200 is composed of a set of eight toner marks. In the example shown in FIG. 5, a train of ladder patterns 200 corresponding to the sensor 17 and a train of ladder patterns 200 corresponding to the sensor 18 are formed on the intermediate transfer belt 5'.

Furthermore, in the example shown in FIG. 5, detection-timing correction patterns 110 each composed of two Y-color lines extending parallel to the main scanning direction at a distance along the sub-scanning direction are formed in the head of the train of ladder patterns 200 corresponding to the sensor 17 and the head of the train of ladder patterns 200 corresponding to the sensor 18, respectively. In this example, the misregistration correction pattern image includes the detection-timing correction patterns 110 and the ladder patterns 200; however, the detection-timing correction patterns 110 can be eliminated from the misregistration correction pattern image.

When the sensors 17 and 18 have detected the detection-timing correction patterns 110 just before detecting the ladder patterns 200, the control unit 30 calculates time between the start of formation of the pattern image (the start of exposure) and the arrival of the pattern image in the position of detection by the sensors 17 and 18. Then, the control unit 30 calculates an error between a theoretical value and the actually-calculated time, and controls the LEDA control unit 39 so as to eliminate the error. Consequently, it is possible to detect the ladder patterns 200 at appropriate timing. The control unit 30 can also correct the write position of each color image with respect to the leading edge of a sheet on the basis of a result of the detection of the detection-timing correction patterns 110. A shift amount of the image write position is caused by tolerance of incident angle of an LEDA or laser light to the photosensitive drum 9 or a change in conveying speed of the intermediate transfer belt 5', and this shift appears in a result of detection of the detection-timing correction patterns 110; therefore, the image write position (the exposure timing of the LEDA control unit 39) can be corrected by detecting the detection-timing correction patterns 110.

By using a Y-color pattern formed by the first station (Y) as the detection-timing correction pattern 110, a conveying distance of the detection-timing correction pattern 110 to the sensor detection position is increased, and the influence of a belt error or the like is increased, and thus the correction effect is increased. On the other hand, if a K-color pattern is used as the detection-timing correction pattern 110, a detection error is reduced, and the correction accuracy is improved. Alternatively, the detection-timing correction pattern 110 can be one set of horizontal line patterns each composed of C, M, Y, and K-color lines extending parallel to the main scanning direction which are placed at equal spaces along the sub-scanning direction. Moreover, the detection-timing correction pattern 110 can be one set of horizontal line patterns 200A in ladder patterns 200 or one set of ladder patterns 200.

Here we explain an example of misregistration correction applicable to the embodiment. In this example, the control unit 30 calculates an amount of misregistration used in misregistration correction by measuring respective spaces between toner marks composing a horizontal line pattern 200A of a ladder pattern 200, toner marks of horizontal line patterns 200A, and toner marks of diagonal line patterns 200B.

In this example, the control unit 30 samples results of detections of toner marks composing the horizontal line patterns 200A and diagonal line patterns 200B by the detecting unit 40 in predetermined sampling cycles, and measures an interval of time between detections of each toner mark of a horizontal line pattern 200A and each toner mark of a diagonal line pattern 200B, thereby acquiring a distance between the toner marks composing the horizontal line pattern 200A and diagonal line pattern 200B. Furthermore, the control unit 30 calculates an amount of misregistration by measuring a distance between the same color toner marks in a horizontal line pattern 200A and a diagonal line pattern 200B and comparing respective distances among the Y, M, C, and K-color toner marks.

Figure 6:
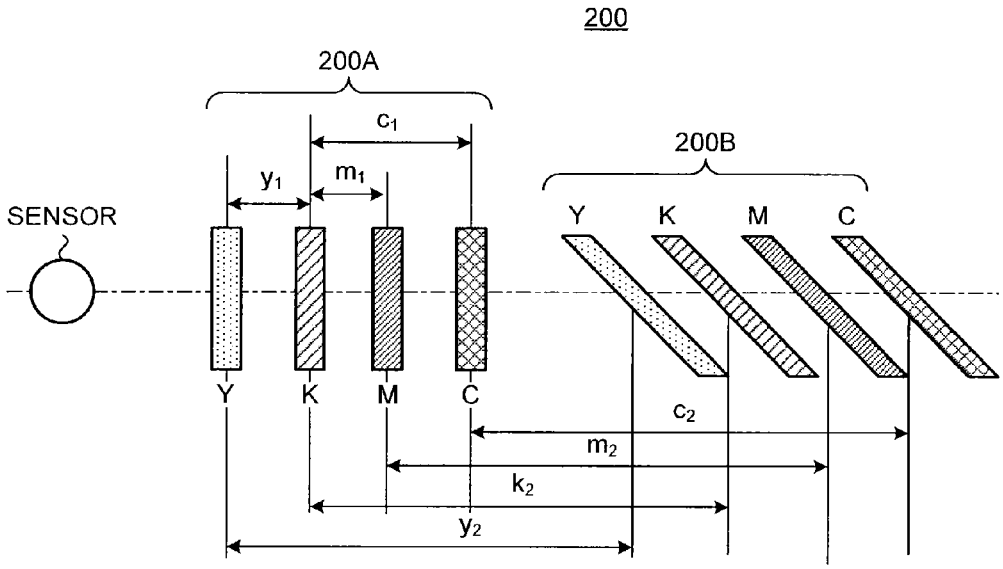
FIG. 6 is a diagram for explaining an example of how to calculate an amount of misregistration.

The calculation of an amount of misregistration is explained more specifically with FIG. 6. To calculate an amount of misregistration in the sub-scanning direction, by using a horizontal line pattern 200A, respective pattern spaces ($y_1$, $m_1$, $c_1$) between a reference K-color toner mark and the other Y, M, and C-color toner marks in the horizontal line pattern 200A are measured. Then, by comparing the measurement results with respective ideal distances to the reference color toner mark, an amount of misregistration in the sub-scanning direction can be calculated. For example, the ideal distances may be measured in advance, e.g., in the adjustment before shipment, and values thereof may be stored in a non-volatile storage device (not shown).

To calculate an amount of misregistration in the main scanning direction, respective spaces ($y_2$, $k_2$, $m_2$, $c_2$) between the same color toner marks in a horizontal line pattern 200A and a diagonal line pattern 200B are measured. As the toner marks of the diagonal line pattern 200B are at a 45-degree angle to the main scanning direction, a difference in the measured space between the reference color (K color) and each of the other Y, M, and C colors is an amount of misregistration of each of Y, M, and C-color images in the main scanning direction. For example, an amount of misregistration of a Y-color image in the main scanning direction is calculated by $k_2-y_2$. As described above, amounts of misregistration of each color image in the sub-scanning direction and the main scanning direction can be obtained by using the ladder pattern 200.

Such a misregistration-amount calculating process can be executed by using, for example, at least one ladder pattern 200. Furthermore, for example, by using multiple ladder patterns 200 to calculate an amount of misregistration of each color image, a misregistration correcting process can be performed with higher accuracy. For example, statistical processing, such as averaging, can be performed on a misregistration amount calculated by using multiple ladder patterns 200 to calculate an amount of misregistration of each color image. The control unit 30 can correct the image write position by using an amount of misregistration calculated as described above.

Figure 7:
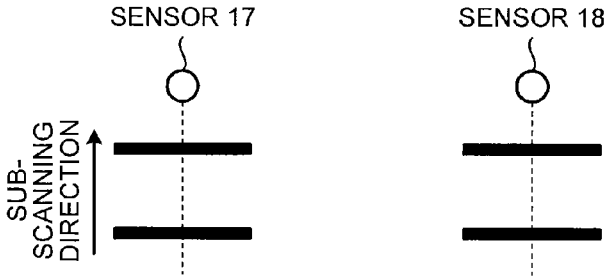
FIG. 7 is a diagram showing an example of a misregistration correction pattern image for black-and-white images.

FIG. 7 is a diagram showing an example of a misregistration correction pattern image for black-and-white images. In the embodiment, under the control of the control unit 30, the image forming unit 6 forms a misregistration correction pattern image for black-and-white images on the intermediate transfer belt 5' driven at predetermined speed. More specifically, the image forming unit 6 forms two K-color lines extending parallel to the main scanning direction as illustrated in FIG. 7 as a misregistration correction pattern image for black-and-white images on the intermediate transfer belt 5' driven at predetermined speed. Upon detection of the pattern composed of the K-color lines illustrated in FIG. 7, the control unit 30 calculates time between the start of formation of the pattern image (the start of exposure) and the arrival of the pattern image in the position of detection by the sensors 17 and 18. Then, the control unit 30 calculates an error between a theoretical value and the actually-calculated time, and controls the LEDA control unit 39 so as to eliminate the error. Furthermore, the control unit 30 can also correct the write position of each color image with respect to the leading edge of a sheet on the basis of a result of the detection of the pattern. A shift amount of the image write position is caused by tolerance of incident angle of an LEDA or laser light to the photosensitive drum 9 or a change in conveying speed of the intermediate transfer belt 5', and this shift shows up in a pattern detection result; therefore, the image write position can be corrected by detecting the pattern.

Figure 8:
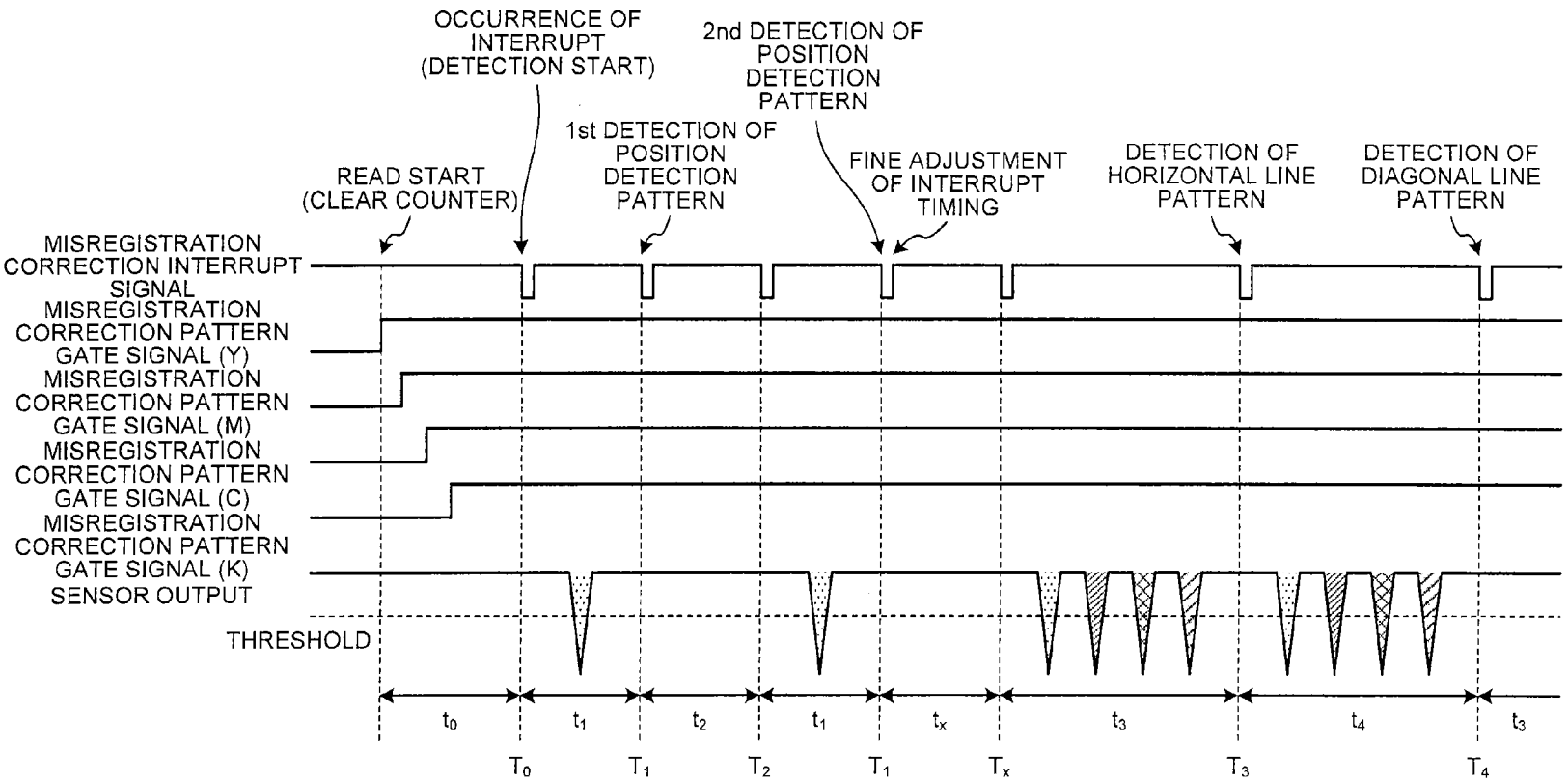
FIG. 8 is a diagram for explaining timing to detect the misregistration correction pattern image.

Subsequently, the timing to detect a misregistration correction pattern image for color images formed on the intermediate transfer belt 5' is explained with reference to FIG. 8. First, at the start of formation of a misregistration correction pattern image (assertion of a gate signal), a pattern detection counter is reset. Next, the control unit 30 sets timing T0 to generate the first interrupt signal (corresponding to the position of a few millimeters short of the position at which the first Y-color horizontal line pattern composing a detection-timing correction pattern 110 is detected), and, when it comes to the timing T0, generates an interrupt signal and again resets the pattern detection counter. Furthermore, the control unit 30 sets timing T1 to generate the next interrupt signal.

Before it comes to the timing T1, the first Y-color horizontal line pattern of the detection-timing correction pattern 110 is detected by the sensor 17 or 18, so an output signal from the sensor 17 or 18 exceeds a threshold value. A count value at that time is stored in a timing storage register (not shown). When it comes to the timing T1, the control unit 30 generates an interrupt signal, and therefore acquires information on the timing to detect the first Y-color horizontal line pattern of the detection-timing correction pattern 110 by reading the timing storage register. Next, the control unit 30 sets timing T2 to generate the next interrupt signal. The control unit 30 repeats this two times.

After the completion of detection of the second Y-color horizontal line pattern of the detection-timing correction pattern 110, the control unit 30 finds an error between ideal detection timing and the actual detection timing from the detection timing information of the first Y-color horizontal line pattern and the detection timing information of the second Y-color horizontal line pattern, and calculates timing TX to generate the next interrupt signal on the basis of this error and sets the timing TX. Consequently, when a horizontal line pattern 200A or a diagonal line pattern 200B of a ladder pattern 200 is detected, an interrupt signal can be generated at the right timing.

When it comes to the timing TX, the control unit 30 generates the next interrupt signal. Afterwards, the control unit 30 repeatedly sets interrupt timing T3 for defining a period t3 of acquiring a result of detection of a horizontal line pattern 200A of a ladder pattern 200 (a period of loading a result of detection of a horizontal line pattern 200A of a ladder pattern 200 into the storage unit 35) and interrupt timing T4 for defining a period t4 of acquiring a result of detection of a diagonal line pattern 200B of the ladder pattern 200, and acquires information on the detected pattern. An interval of interrupt such as t0 and t1, the width of a pattern (a toner mark), and the image formation rate of generating the pattern are comprehensively determined from the printing speed of the image forming apparatus 100, the conveyance speed of the intermediate transfer belt 5', and the sampling cycles, etc.

As for the detection of a misregistration correction pattern image for black-and-white images, it is configured to detect only two K-color patterns, and the flow of T0→T1→T2→T1 is conducted on the two K-color patterns.

Figure 9:
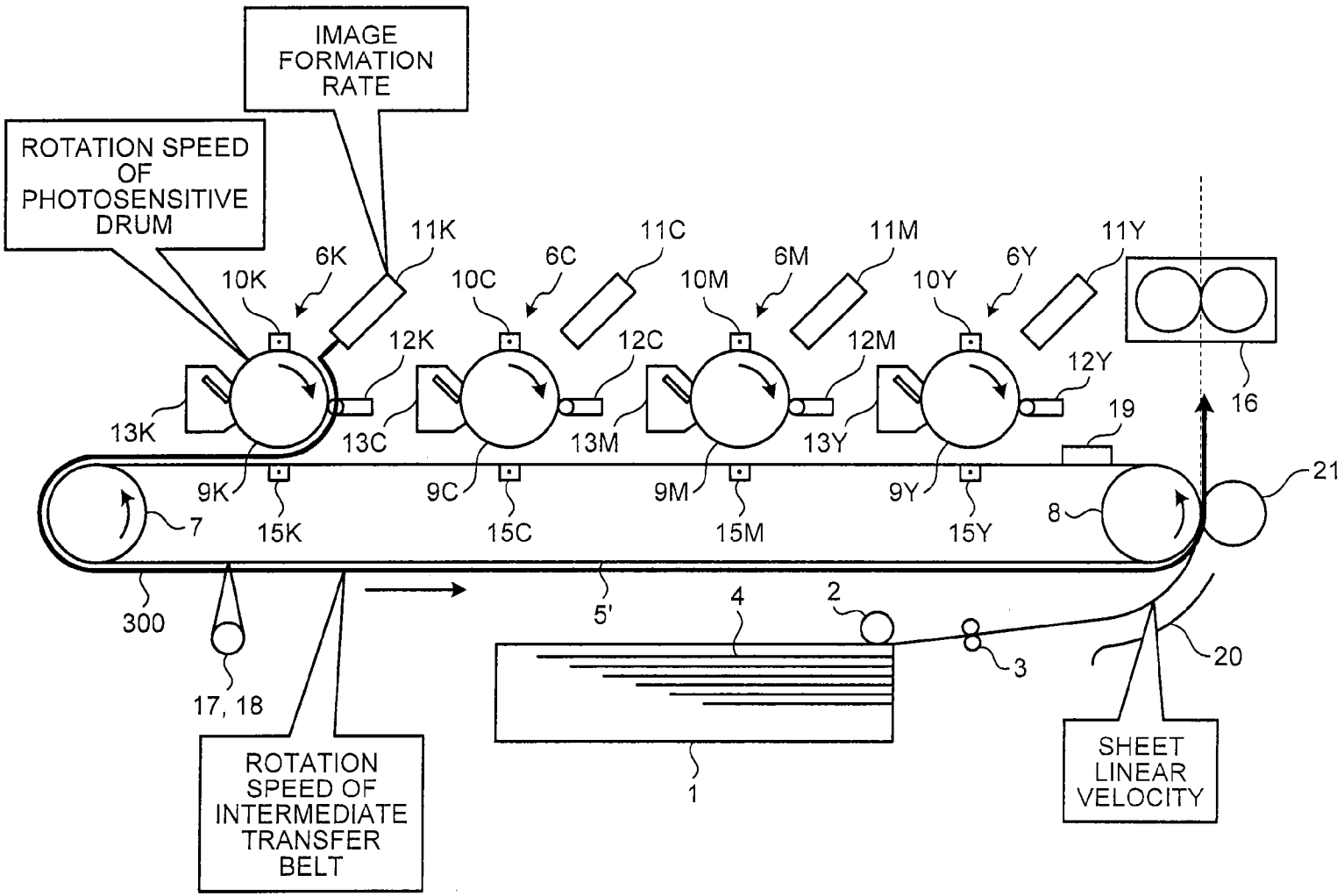
FIG. 9 is a diagram for explaining rotation speed of each module in the image forming apparatus.

Subsequently, rotation speed of each module in the image forming apparatus 100 is explained with reference to FIG. 9. At the time of printing, a toner image passes along a path 300 indicated by an arrow shown in FIG. 9. Here, only the most downstream image forming unit 6K is described. The image formation rate for controlling the timing to expose the photosensitive drum 9 to light is determined by the emission timing of the LEDA head 11 (the writing linear velocity). Furthermore, the timing to transfer an image onto the intermediate transfer belt 5' (the imaging linear velocity) is determined by the rotation speed of the photosensitive drum 9 and the rotation speed of the intermediate transfer belt 5'. Moreover, the timing to transfer the image onto a sheet 4 and the magnification in the sub-scanning direction are determined by a ratio between the rotation speed of the intermediate transfer belt 5' and the sheet linear velocity which is the speed at which the sheet 4 is conveyed.

Therefore, depending on the rotation speeds of the modules, the sub-scanning directional transfer position and magnification of an image to be finally appeared on the sheet 4 are determined, and an abnormal image with lateral stripes (bandings), density unevenness, or magnification deviation, etc. may be generated. Furthermore, when the thickness of a sheet 4 is larger than normal, the fixing time has to be increased to ensure fixing heat; therefore, printing operation is performed at reduced rotation speed. Namely, rotation speed of each module is set according to a type of sheet 4 used in printing (each module has several types of rotation speed according to types of sheets 4). With respect to a relationship between ideal rotation speed of the photosensitive drum 9 and ideal rotation speed of the intermediate transfer belt 5', if there is a difference in speed among the rotation speed of the photosensitive drum 9, the rotation speed of the intermediate transfer belt 5', and the sheet linear velocity due to variation in diameter of the actual photosensitive drum 9, thickness of the actual intermediate transfer belt 5', or diameter of the actual registration roller, etc., the ideal relationship is broken. This shifts the timing to transfer an image onto the intermediate transfer belt 5', and regular lateral stripes (bandings) in the sub-scanning direction appear on a portion of an image which expresses gradation. Furthermore, if the sheet linear velocity is higher than the rotation speed of the intermediate transfer belt 5', an image is elongated in the sub-scanning direction (the image magnification in the sub-scanning direction varies).

To prevent the above problems, there is a conceivable method in which with respect to each rotation speed according to a type of sheet 4, a misregistration correction pattern is detected, and a misregistration correction amount is calculated, and then the correction depending on the calculated misregistration correction amount is performed. However, this method is not realistic because user down-time is significantly increased.

Therefore, in the present embodiment, when printing is performed with a reference sheet linear velocity (hereinafter, sometimes referred to as a "first sheet linear velocity") out of multiple preset sheet linear velocities, misregistration correction (default misregistration correction) is performed by detection of a misregistration correction pattern image. Then, when the sheet linear velocity has been changed to a second sheet linear velocity, which is a sheet linear velocity other than the first sheet linear velocity, along with a change in a type of sheet 4 used in printing, an adjustment amount which has been used in a default misregistration correction is corrected according to a ratio between a first coefficient indicating a ratio of an actual image formation rate at the first sheet linear velocity to an ideal image formation rate and a second coefficient indicating a ratio of an actual image formation rate at the second sheet linear velocity to an ideal image formation rate. Then, the exposure timing is changed in accordance with the corrected adjustment amount. Namely, according to the present embodiment, even if the sheet linear velocity is changed after the default misregistration correction, the occurrence of banding, etc. can be suppressed without again performing misregistration correction based on a result of detection of a misregistration correction pattern image; therefore, it is possible to suppress deterioration of the image quality without increasing the user down-time. The concrete content is explained below.

Figures 10, 11:
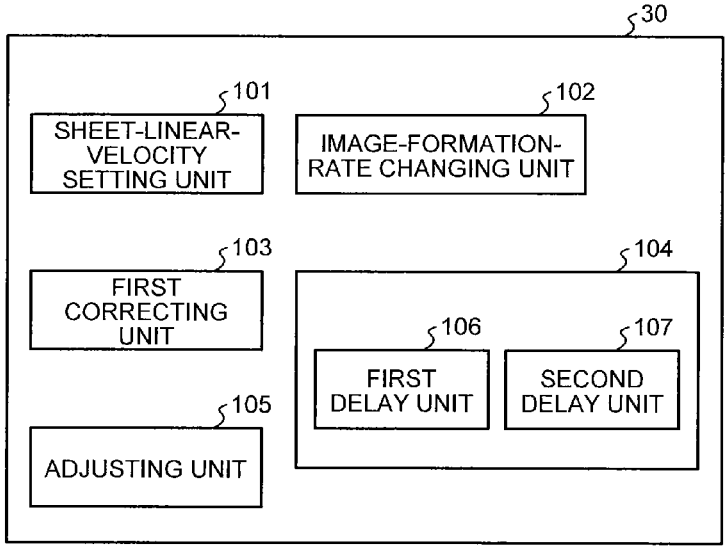
FIG. 10 is a block diagram showing an example of functions that a control unit has.
FIG. 11 is a diagram for explaining respective misregistration correction controls in cases of multiple sheet linear velocities that the image forming apparatus has.

FIG. 10 is a block diagram showing an example of functions that the control unit 30 has. As shown in FIG. 10, the control unit 30 includes a sheet-linear-velocity setting unit 101, an image-formation-rate changing unit 102, a first correcting unit 103, a second correcting unit 104, and an adjusting unit 105. The sheet-linear-velocity setting unit 101 variably sets a sheet linear velocity, which indicates the speed at which a sheet 4 is conveyed, according to a type of sheet 4 used in printing. The image-formation-rate changing unit 102 changes the image formation rate, which indicates a cycle of image formation by the LEDA control unit 39, according to the sheet linear velocity set by the sheet-linear-velocity setting unit 101. The first correcting unit 103 performs, when printing is performed with a first sheet linear velocity indicating a reference sheet linear velocity, misregistration correction according to a result of detection of a misregistration correction pattern image by the detecting unit 40. The adjusting unit 105 has a function of adjusting the image formation rate in response to operation input by a serviceman who provides a service, such as maintenance, or a user, etc.

The second correcting unit 104 corrects, when the sheet-linear-velocity setting unit 101 has set a second sheet linear velocity indicating a sheet linear velocity other than the first sheet linear velocity, an adjustment amount which has been used in the misregistration correction performed by the first correcting unit 103, according to a ratio between a first coefficient indicating a ratio of an actual image formation rate at the first sheet linear velocity to an ideal image formation rate and a second coefficient indicating a ratio of an actual image formation rate at the second sheet linear velocity to an ideal image formation rate. In this example, the "adjustment amount" means an amount of delay in exposure timing, and the second correcting unit 104 corrects the adjustment amount which has been used in the misregistration correction performed by the first correcting unit 103, by multiplying the adjustment amount by a value of the ratio between the first coefficient and the second coefficient. Then, the second correcting unit 104 delays the exposure timing in accordance with the corrected adjustment amount. For more details, we will describe later; however, in the embodiment, an adjustment amount (an amount of delay in exposure timing) is expressed as the number of lines in the sub-scanning direction, which indicates a cycle of image formation by the LEDA control unit 39. The second correcting unit 104 includes a first delay unit 106 and a second delay unit 107. The first delay unit 106 performs control of delaying the exposure timing by an amount corresponding to an integer part of the number of lines expressing a corrected adjustment amount. The second delay unit 107 performs control of delaying the exposure timing by an amount corresponding to a clock number obtained by multiplying a clock number indicating the actual image formation rate at the second sheet linear velocity by a fractional part of the line number expressing the corrected adjustment amount. The concrete content is explained below.

FIG. 11 is a diagram for explaining misregistration correction controls in cases of multiple (three, in this example) sheet linear velocities that the image forming apparatus 100 according to the present embodiment has. As shown in FIG. 11, the image forming apparatus 100 has three sheet linear velocities: "first speed" indicating a sheet linear velocity set when printing is performed on a sheet 4 having the same thickness as plain paper, "medium speed" indicating a sheet linear velocity set when printing is performed on a sheet 4 thicker than plain paper, such as heavy paper, and "low speed" indicating a sheet linear velocity set when printing is performed on a sheet 4 thicker than heavy paper, such as a postcard.

First, the "first speed" is explained. In the example shown in FIG. 11, the sheet linear velocity corresponding to the "first speed" is 144 mm/sec, and the line period corresponding to the "first speed" is 73.50 μs. Furthermore, an ideal value (a default value) of an image formation rate corresponding to the "first speed" is expressed by a clock number of "4335". Moreover, an actual image formation rate (the number of clocks per line) when the sheet linear velocity is set to the "first speed" is denoted by "SP1". The control unit 30 has a function of acquiring a value of the actual image formation rate. A method for acquiring a value of the actual image formation rate is optional, and various well-known technologies can be used. The SP1 is adjusted by the adjusting unit 105 in response to serviceman or user input, thereby the sub-scanning magnification on an image is adjusted. For example, a serviceman or user can lower the sub-scanning magnification by inputting an instruction to set the SP1 to a lower value.

The line period is expressed by the following equation (1).

$$\text{Line period [μs]}=\text{Sub-scanning resolution [dpi]}(2400\ \text{dpi: } 10.6\ \mu\text{s})/\text{Sheet linear velocity [mm/sec]} \quad (1)$$

The clock period is expressed by the following equation (2).

$$\text{Clock period [μs]}=1/\text{Reference clock frequency [MHz]}(\text{Original frequency}\times 3=19.6608\times 3=55.9824\ \text{[MHz]}) \quad (2)$$

In the above equation (2), the reference clock points to a high-frequency clock obtained by increasing a frequency of an output signal derived from a basic oscillation circuit with a phase-locked loop (PLL). The original frequency points to an original frequency of a crystal oscillator in the basic oscillation circuit.

Moreover, the image formation rate is expressed by the following equation (3). In the calculation of the image formation rate, the image formation rate is all rounded to five or more significant digits.

$$\text{Image formation rate[clock number]}=\text{Line period [μs]}/\text{Clock period [μs]} \quad (3)$$

As shown in FIG. 11, a linear-velocity adjustment coefficient αh, which indicates a ratio of the actual image formation rate (clock number: SP1) at the "first speed" to the ideal image formation rate (clock number: 4335), is expressed by "SP1/4335". In this example, the "first speed" corresponds to a "first sheet linear velocity" in claims, and the "linear-velocity adjustment coefficient αh" corresponds to a "first coefficient" in claims. Therefore, when the sheet linear velocity is set to the "first speed", misregistration correction (misregistration correction based on a result of detection of a misregistration correction pattern image) is performed by the first correcting unit 103.

A per-line delay amount (the number of clocks between stations) for each color at the "first speed", which corresponds to a distance from the first station (in this example, Y color station) in the sub-scanning direction (the conveying direction of a sheet 4), can be expressed as follows. First, a K-color delay amount per line (a per-line K delay amount) can be expressed by the following equation (4).

$$\text{Per-line } K \text{ delay amount}=\text{offset_}yk+SP(\text{Color shift correction amount of line } Bk)+SP(\text{Color shift adjustment amount of line } Bk) \quad (4)$$

In the above equation (4), offset_yk denotes a distance between primary transfer portions, and indicates a distance in the sub-scanning direction between the Y color station (i.e., the first station) and the K color station, and, in this example, is expressed by a line number of "19973". The color shift correction amount of line Bk indicates a K-color misregistration correction amount (an amount of change in timing of exposure by the LEDA head 11K corresponding to K color) used in misregistration correction performed by the first correcting unit 103, and is expressed by a line number in units of an integer part thereof. Furthermore, the color shift adjustment amount of line Bk indicates an amount of adjustment of K-color shift associated with adjustment of the image formation rate in response to operation input by a serviceman, etc., and is expressed by a line number in units of an integer part thereof. Moreover, the SP denotes non-volatile data that can be changed by a control program according to a condition or by a serviceman according to a state of an image.

A C-color delay amount per line (a per-line C delay amount) can be expressed by the following equation (5).

$$\text{Per-line } C \text{ delay amount}=\text{offset_}yc+SP(\text{Color shift correction amount of line } C)+SP(\text{Color shift adjustment amount of line } C) \quad (5)$$

In the above equation (5), offset_yc denotes a distance between primary transfer portions, and indicates a distance in the sub-scanning direction between the Y color station (the first station) and C color station, and, in this example, is expressed by a line number of "13245". The color shift correction amount of line C indicates a C-color misregistration correction amount (an amount of change in timing of exposure by the LEDA head 11C corresponding to C color) used in misregistration correction performed by the first correcting unit 103, and is expressed by a line number in units of an integer part thereof. Furthermore, the color shift adjustment amount of line C indicates an amount of adjustment of C-color shift associated with adjustment of the image formation rate in response to operation input by a serviceman, etc., and is expressed by a line number in units of an integer part thereof.

An M-color delay amount per line (a per-line M delay amount) can be expressed by the following equation (6).

$$\text{Per-line } M \text{ delay amount} = \text{offset_}ym + SP(\text{Color shift correction amount of line } M) + SP(\text{Color shift adjustment amount of line } M) \quad (6)$$

In the above equation (6), offset_ym denotes a distance between primary transfer portions, and indicates a distance in the sub-scanning direction between the Y color station (the first station) and M color station, and, in this example, is expressed by a line number of "6622". The color shift correction amount of line M indicates an M-color misregistration correction amount (an amount of change in timing of exposure by the LEDA head 11M corresponding to M color) used in misregistration correction performed by the first correcting unit 103, and is expressed by a line number in units of an integer part thereof. Furthermore, the color shift adjustment amount of line M indicates an amount of adjustment of M-color shift associated with adjustment of the image formation rate in response to operation input by a serviceman, etc., and is expressed by a line number in units of an integer part thereof.

Furthermore, a Y-color delay amount per line (a per-line Y delay amount) can be expressed by the following equation (7).

$$\text{Per-line } Y \text{ delay amount} = SP(\text{Color shift correction amount of line } Y) + SP(\text{Color shift adjustment amount of line } Y) \quad (7)$$

In the above equation (7), the color shift correction amount of line Y indicates a Y-color misregistration correction amount (an amount of change in timing of exposure by the LEDA head 11Y corresponding to Y color) used in misregistration correction performed by the first correcting unit 103, and is expressed by a line number in units of an integer part thereof. Furthermore, the color shift adjustment amount of line Y indicates an amount of adjustment of Y-color shift associated with adjustment of the image formation rate in response to operation input by a serviceman, etc., and is expressed by a line number in units of an integer part thereof.

To perform the sub-scanning misregistration correction with high accuracy, it is preferable to adjust a delay amount corresponding to a distance from the first station with an accuracy of less than one line with respect to each color. This delay amount is referred to as a "delay amount of less than one line", and can be expressed by a clock number to delay in units of clocks between the stations. In the description below, a delay amount of less than one line for K color is referred to as a K delay amount of less than one line, a delay amount of less than one line for C color is referred to as a C delay amount of less than one line, a delay amount of less than one line for M color is referred to as an M delay amount of less than one line, and a delay amount of less than one line for Y color is referred to as a Y delay amount of less than one line.

For example, assume that a distance in the sub-scanning direction corresponding to a K-color misregistration correction amount used in misregistration correction performed by the first correcting unit 103 is 15.6 μm. In this example, a distance in the sub-scanning direction corresponding to one line is 10.6 μm, so the line number indicating an integer-valued delay amount is expressed by "1", and a delay amount of less than one line is expressed by a clock number of "2045" corresponding to 5.0 μm (=15.6 μm−10.6 μm) which is a distance less than one line in the sub-scanning direction.

The first delay unit 106 performs control of delaying the exposure timing by time corresponding to a per-line delay amount for each color (expressed by a line number in units of an integer part thereof). Furthermore, the second delay unit 107 performs control of delaying the exposure timing by time corresponding to a delay amount of less than one line for each color (expressed by a clock number). In this manner, misregistration correction at the "first speed" is performed.

Additionally, when color printing or specified CMY color printing is performed with the "first speed", a per-line delay amount for each color is expressed as follows. First, a K-color delay amount per line (a per-line K delay amount in color printing) can be expressed by the following equation (8).

$$\text{Per-line } K \text{ delay amount in color printing} = \text{Per-line } K \text{ delay amount} - \text{Per-line } Y \text{ delay amount} + 1 \quad (8)$$

A C-color delay amount per line (a per-line C delay amount in color printing) can be expressed by the following equation (9).

$$\text{Per-line } C \text{ delay amount in color printing} = \text{Per-line } C \text{ delay amount} - \text{Per-line } Y \text{ delay amount} + 1 \quad (9)$$

An M-color delay amount per line (a per-line M delay amount in color printing) can be expressed by the following equation (10).

$$\text{Per-line } M \text{ delay amount in color printing} = \text{Per-line } M \text{ delay amount} - \text{Per-line } Y \text{ delay amount} + 1 \quad (10)$$

A Y-color delay amount per line (a per-line Y delay amount in color printing) can be expressed by the following equation (11).

$$\text{Per-line } Y \text{ delay amount in color printing} = 1 \quad (11)$$

Also, when color printing or specified CMY color printing is performed with the "first speed", a delay amount of less than one line is set with respect to each color.

Furthermore, when black-and-white printing is performed with the "first speed", a per-line delay amount for each color is expressed as follows. First, a K-color delay amount per line (a per-line K delay amount in black-and-white printing) can be expressed by the following equation (12).

$$\text{Per-line } K \text{ delay amount in black-and-white printing} = 1 \quad (12)$$

A C-color delay amount per line (a per-line C delay amount in black-and-white printing) can be expressed by the following equation (13).

$$\text{Per-line } C \text{ delay amount in black-and-white printing} = 0 \quad (13)$$

An M-color delay amount per line (a per-line M delay amount in black-and-white printing) can be expressed by the following equation (14).

$$\text{Per-line } M \text{ delay amount in black-and-white printing} = 0 \quad (14)$$

A Y-color delay amount per line (a per-line Y delay amount in black-and-white printing) can be expressed by the following equation (15).

$$\text{Per-line } Y \text{ delay amount in black-and-white printing} = 0 \quad (15)$$

In addition, as for a delay amount of less than one line for each color when black-and-white printing is performed with the "first speed", it is only necessary to set a K-color delay amount of less than one line at the "first speed", and there is no need to set a C-color delay amount of less than one line, an M-color delay amount of less than one line, and a Y-color delay amount of less than one line.

Next, misregistration correction control performed when the sheet linear velocity has been changed from the "first speed" to the "medium speed" along with a change in a type of sheet 4 used in printing from plain paper to heavy paper is explained. In the example shown in FIG. 11, the sheet linear velocity corresponding to the "medium speed" is 90 mm/sec, and the line period corresponding to the "medium speed" is 117.59 μs. Furthermore, an ideal value (a default value) of an image formation rate corresponding to the "medium speed" is expressed by a clock number of "6936". Moreover, a value of an actual image formation rate (a clock number) when the sheet linear velocity is set to the "medium speed" is denoted by "SP2".

Furthermore, a linear-velocity adjustment coefficient αm, which indicates a ratio of the actual image formation rate (clock number: SP2) at the "medium speed" to the ideal image formation rate (clock number: 6936), is expressed by "SP2/6936". Here, it can be considered that the "medium speed" corresponds to a "second sheet linear velocity" in claims, and the "linear-velocity adjustment coefficient am" corresponds to a "second coefficient" in claims.

Here, a per-line delay amount for each color at the "medium speed" before correction by the second correcting unit 104 is performed can be expressed as follows. First, a K-color delay amount per line (a before-correction per-line K delay amount) can be expressed by the following equation (16).

$$\text{Before-correction per-line } K \text{ delay amount} = \text{offset_}yk + SP(\text{Color shift correction amount of line } Bk) + SP(\text{Color shift adjustment amount of line } Bk) + \text{offset_mid_}yk \quad (16)$$

In the above equation (16), a part other than offset_mid_yk is identical to the per-line K delay amount at the "first speed" (see the equation (4)). The offset_mid_yk denotes an offset value of a delay amount corresponding to a Y-to-K distance when the sheet linear velocity has been changed to the "medium speed", and is expressed by −93.21/ah (rounded off to two decimal places). The value of −93.21 is an offset value when the LEDA writing linear velocity (the image formation rate) is equal to the imaging linear velocity, and is expressed as a line number. In this example, ah equals 0.99, and offset_mid_yk is expressed by a line number of "−94". Incidentally, the above equation (16) can be modified by excluding offset_mid_yk. In this case, a per-line K delay amount at the "medium speed" before correction by the second correcting unit 104 is performed is the same value as the per-line K delay amount at the "first speed".

A C-color delay amount per line (a before-correction per-line C delay amount) can be expressed by the following equation (17).

$$\text{Before-correction per-line } C \text{ delay amount} = \text{offset_}yc + SP(\text{Color shift correction amount of line } C) + SP(\text{Color shift adjustment amount of line } C) + \text{offset_}mid_yc \quad (17)$$

The offset_mid_yc denotes an offset value of a delay amount corresponding to a Y-to-C distance when the sheet linear velocity has been changed to the "medium speed", and is "0" in this example.

An M-color delay amount per line (a before-correction per-line M delay amount) can be expressed by the following equation (18).

$$\text{Before-correction per-line } M \text{ delay amount} = \text{offset_}ym + SP(\text{Color shift correction amount of line } M) + SP(\text{Color shift adjustment amount of line } C) + \text{offset_}mid_ym \quad (18)$$

The offset_mid_ym denotes an offset value of a delay amount corresponding to a Y-to-M distance when the sheet linear velocity has been changed to the "medium speed", and is "0" in this example.

A Y-color delay amount per line (a before-correction per-line Y delay amount) can be expressed by the following equation (19).

$$\text{Before-correction per-line } Y \text{ delay amount} = SP(\text{Color shift correction amount of line } Y) + SP(\text{Color shift adjustment amount of line } Y) \quad (19)$$

Also, a delay amount of less than one line at the "medium speed" before correction is performed by the second correcting unit 104 can be set with respect to each color.

Here, the second correcting unit 104 corrects an adjustment amount for each color by multiplying an adjustment amount for each color when misregistration correction (default misregistration correction) is performed by the first correcting unit 103 by a value of a ratio of the linear-velocity adjustment coefficient ah at the "first speed" to the linear-velocity adjustment coefficient am at the "medium speed" (αh/αm). An adjustment amount for each color at the "medium speed" after the correction by the second correcting unit 104 can be expressed as follows. First, a K-color delay amount (an "after-correction K delay amount") can be expressed by the following equation (20) (a value of a delay amount is rounded off to one decimal place).

$$\text{After-correction } K \text{ delay amount} = \{(\text{Before-correction per-line } K \text{ delay amount} - \text{Before-correction per-line } Y \text{ delay amount} + 1) + (\text{Before-correction } K \text{ delay amount of less than one line}/SP2)\} \times (\alpha h/\alpha m) \quad (20)$$

In the above equation (20), a part other than (αh/αm) corresponds to a K-color adjustment amount when misregistration correction (default misregistration correction) is performed by the first correcting unit 103, and is expressed as a line number indicating an amount of delay in exposure timing. It is noted that "1" in the equation (20) is a default value, and a value of part exceeding 1 is an object to be controlled. The default value is not limited to "1", and any value (for example, 0) is adoptable.

Likewise, an after-correction C delay amount can be expressed by the following equation (21).

$$\text{After-correction } C \text{ delay amount} = \{(\text{Before-correction per-line } C \text{ delay amount} - \text{Before-correction per-line } Y \text{ delay amount} + 1) + (\text{Before-correction } C \text{ delay amount of less than one line}/SP2)\} \times (\alpha h/\alpha m) \quad (21)$$

An after-correction M delay amount can be expressed by the following equation (22).

$$\text{After-correction } M \text{ delay amount} = \{(\text{Before-correction per-line } M \text{ delay amount} - \text{Before-correction per-line } Y \text{ delay amount} + 1) + (\text{Before-correction } M \text{ delay amount of less than one line}/SP2)\} \times (\alpha h/\alpha m) \quad (22)$$

An after-correction Y delay amount can be expressed by the following equation (23).

$$\text{After-correction } Y \text{ delay amount} = \{1 + (\text{Before-correction } Y \text{ delay amount of less than one line}/SP2)\} \times (\alpha h/\alpha m) \quad (23)$$

The first delay unit 106 performs control of delaying the exposure timing by an amount of time corresponding to an integer part of the delay amount (the after-correction delay amount) for each color calculated as described above.

Furthermore, the second delay unit 107 performs control of delaying the exposure timing by an amount of time corresponding to a fractional part (a delay amount of less than one line) of the delay amount (the after-correction delay amount) for each color calculated as described above. In this example, the second delay unit 107 converts a unit of a delay amount of less than one line from a line number to a clock number by multiplying a fractional part of the after-correction delay amount for each color by the actual image formation rate SP2 at the "medium speed", and performs control of delaying the exposure timing by the converted clock number (controls a delay amount in units of clocks).

The after-correction delay amount of less than one line for each color (the clock number corresponding to the fractional part of the after-correction delay amount for each color) can be expressed as follows. First, an after-correction K delay amount of less than one line can be expressed by the following equation (24) (a value of a delay amount is rounded off to the whole number).

$$\text{After-correction } K \text{ delay amount of less than one line} = SP2 \times \text{After-correction } K \text{ delay amount [fractional part]} \quad (24)$$

An after-correction C delay amount of less than one line, an after-correction M delay amount of less than one line, and an after-correction Y delay amount of less than one line can be obtained in the same manner.

In addition, a per-line delay amount for each color when color printing or specified CMY color printing is performed with the "medium speed" is expressed as follows. First, a K-color delay amount per line (a per-line K delay amount in color printing) can be expressed by the following equation (25).

$$\text{Per-line } K \text{ delay amount in color printing} = \text{After-correction } K \text{ delay amount [integer part]} \quad (25)$$

A C-color delay amount per line (a per-line C delay amount in color printing) can be expressed by the following equation (26).

$$\text{Per-line } C \text{ delay amount in color printing} = \text{After-correction } C \text{ delay amount [integer part]} \quad (26)$$

An M-color delay amount per line (a per-line M delay amount in color printing) can be expressed by the following equation (27).

$$\text{Per-line } M \text{ delay amount in color printing} = \text{After-correction } M \text{ delay amount [integer part]} \quad (27)$$

A Y-color delay amount per line (a per-line Y delay amount in color printing) can be expressed by the following equation (28).

$$\text{Per-line } Y \text{ delay amount in color printing} = 1 \quad (28)$$

In addition, a K delay amount of less than one line when color printing or specified CMY color printing is performed with the "medium speed" can be expressed in the same manner as the above equation (24). The same goes for the other C, M, and Y colors.

Furthermore, a per-line delay amount for each color when black-and-white printing is performed with the "medium speed" is expressed as follows. First, a K-color delay amount per line (a per-line K delay amount in black-and-white printing) can be expressed by the following equation (29).

$$\text{Per-line } K \text{ delay amount in black-and-white printing} = 1 \quad (29)$$

A C-color delay amount per line (a per-line C delay amount in black-and-white printing) can be expressed by the following equation (30).

$$\text{Per-line } C \text{ delay amount in black-and-white printing} = 0 \quad (30)$$

An M-color delay amount per line (a per-line M delay amount in black-and-white printing) can be expressed by the following equation (31).

$$\text{Per-line } M \text{ delay amount in black-and-white printing} = 0 \quad (31)$$

A Y-color delay amount per line (a per-line Y delay amount in black-and-white printing) can be expressed by the following equation (32).

$$\text{Per-line } Y \text{ delay amount in black-and-white printing} = 0 \quad (32)$$

As for a delay amount of less than one line for each color when black-and-white printing is performed with the "medium speed", it is only necessary to set a K-color delay amount of less than one line, and there is no need to set a C-color delay amount of less than one line, an M-color delay amount of less than one line, and a Y-color delay amount of less than one line. The K-color delay amount of less than one line can be expressed by the above equation (24).

Next, misregistration correction control performed when the sheet linear velocity has been changed from the "first speed" to the "low speed" is explained. In the example shown in FIG. 11, the sheet linear velocity corresponding to the "low speed" is 60 mm/sec, and the line period corresponding to the "low speed" is 176.39 μs. Furthermore, an ideal value (a default value) of an image formation rate corresponding to the "low speed" is expressed by a clock number of "10404". Moreover, a value of an actual image formation rate (a clock number) when the sheet linear velocity is set to the "low speed" is denoted by "SP3".

A linear-velocity adjustment coefficient αl, which indicates a ratio of the actual image formation rate (clock number: SP3) at the "low speed" to the ideal image formation rate (clock number: 10404), is expressed by "SP3/10404". In this example, it can be considered that the "low speed" corresponds to the "second sheet linear velocity" in claims, and the "linear-velocity adjustment coefficient αl" corresponds to the "second coefficient" in claims. Except for the SP3 used instead of the SP2 and the linear-velocity adjustment coefficient αl corresponding to the "low speed" used instead of the linear-velocity adjustment coefficient am corresponding to the "medium speed", correction by the second correcting unit 104 is performed in the same manner as in the case of the "medium speed", and therefore detailed explanation is omitted.

As described above, in the present embodiment, when printing is performed with the "first speed", detection of a misregistration correction pattern is performed, and misregistration correction (default misregistration correction) is performed. Then, when the sheet linear velocity has been changed to the "medium speed" (or the "low speed") along with a change in a type of sheet 4 used in printing, an adjustment amount which has been used in the default misregistration correction is corrected according to a ratio between the linear-velocity adjustment coefficient αh, which indicates a ratio of an actual image formation rate at the "first speed" to an ideal image formation rate, and the linear-velocity adjustment coefficient αm, which indicates a ratio of an actual image formation rate at the "medium speed" to an ideal image formation rate (or the linear-velocity adjustment coefficient $\alpha l$ if the sheet linear velocity has been changed to the "low speed"), and the exposure timing is changed in accordance with the corrected adjustment amount. Namely, according to the present embodiment, even if the sheet linear velocity is changed after the default misregistration correction, the occurrence of banding, etc. can be suppressed without again performing misregistration correction based on a result of detection of a misregistration correction pattern image; therefore, it is possible to achieve an advantageous effect of suppressing deterioration of the image quality while suppressing the user down-time.

Meanwhile, respective functions of the sheet-linear-velocity setting unit 101, the image-formation-rate changing unit 102, the first correcting unit 103, the second correcting unit 104 (including the first delay unit 106 and the second delay unit 107), and the adjusting unit 105 are realized by a CPU of the control unit 30 expanding a program stored in a ROM or the like onto a RAM and executing the program; however, it is not limited to this, and, for example, at least some of the respective functions of the sheet-linear-velocity setting unit 101, the image-formation-rate changing unit 102, the first correcting unit 103, the second correcting unit 104, and the adjusting unit 105 can be configured to be realized by a dedicated hardware circuit.

Modifications

Modifications of the embodiment are described below. Modifications can be arbitrarily combined. Furthermore, the following modifications can be arbitrarily combined with the above-described embodiment.

(1) Modification 1

For example, an amount of delay by the second delay unit 107 can be set to a fixed value. This fixed value may be the smallest value within a settable range, and, for example, may be set to "0". In the case where the fixed value is set to "0", an example in which the sheet linear velocity is changed from the "first speed" to the "medium speed" is explained below.

Respective per-line delay amounts for K, C, M, and Y colors at the "medium speed" before correction is performed by the second correcting unit 104 can be expressed by the above-described equations (16) to (19). In contrast, in this example, respective delay amounts of less than one line for K, C, M, and Y colors at the "medium speed" before correction is performed by the second correcting unit 104 are all set to "0" in advance.

Then, respective color delay amounts at the "medium speed" after the correction is performed by the second correcting unit 104 can be expressed as follows. First, a K-color delay amount (an after-correction K delay amount) can be expressed by the following equation (33) (a value of a delay amount is rounded off to one decimal place).

$$\text{After-correction } K \text{ delay amount} = (\text{Before-correction per-line } K \text{ delay amount} - \text{Before-correction per-line } Y \text{ delay amount} + 1) \times (\alpha h / \alpha m) \quad (33)$$

Likewise, a C-color delay amount (an after-correction C delay amount) can be expressed by the following equation (34).

$$\text{After-correction } C \text{ delay amount} = (\text{Before-correction per-line } C \text{ delay amount} - \text{Before-correction per-line } Y \text{ delay amount} + 1) \times (\alpha h / \alpha m) \quad (34)$$

An M-color delay amount (an after-correction M delay amount) can be expressed by the following equation (35).

$$\text{After-correction } M \text{ delay amount} = (\text{Before-correction per-line } M \text{ delay amount} - \text{Before-correction per-line } Y \text{ delay amount} + 1) \times (\alpha h / \alpha m) \quad (35)$$

The first delay unit 106 performs control of delaying the exposure timing by an amount of time corresponding to an integer part of the delay amount (the after-correction delay amount) for each color calculated as described above. A per-line delay amount for each color is expressed as follows. First, a K-color delay amount per line after the correction (an after-correction per-line K delay amount) can be expressed by the following equation (36).

$$\text{After-correction per-line } K \text{ delay amount} = \text{After-correction } K \text{ delay amount[integer part]} \quad (36)$$

An after-correction per-line C delay amount, an after-correction per-line M delay amount, and an after-correction per-line Y delay amount can be found in the same manner.

The second delay unit 107 sets a fractional part (a delay amount of less than one line) of the after-correction delay amount for each color to "0", so the second delay unit 107 does not perform control of delaying the exposure timing. Also in the above configuration, in the same manner as the above-described embodiment, even if the sheet linear velocity is changed after the default misregistration correction, the occurrence of banding, etc. can be suppressed without again performing misregistration correction based on a result of detection of a misregistration correction pattern image. However, according to the above-described embodiment, the exposure timing control reflecting a delay amount of less than one line can be performed, and therefore there is the advantage that the occurrence of banding, etc. can be suppressed with higher accuracy.

Respective per-line delay amounts for K, C, M, and Y colors when color printing or specified CMY color printing is performed with the "medium speed" are expressed by the above-described equations (25) to (28). Respective color delay amounts of less than one line when color printing or specified CMY color printing is performed with the "medium speed" are all set to "0".

Respective per-line delay amounts for K, C, M, and Y colors when black-and-white printing is performed with the "medium speed" can be expressed by the above-described equations (29) to (32) in the same manner as in the above-described embodiment. As for a delay amount of less than one line for each color when black-and-white printing is performed with the "medium speed", it is only necessary to set a K-color delay amount of less than one line, and there is no need to set a C-color delay amount of less than one line, an M-color delay amount of less than one line, and a Y-color delay amount of less than one line; however, in this case, respective delay amounts of less than one line are all set to "0".

It is thought that much the same is true on a case where the sheet linear velocity is changed from the "first speed" to the "low speed".

(2) Modification 2

In the above-described embodiment, the "first speed" corresponds to the "first sheet linear velocity" in claims; however, it is not limited to this, and a sheet linear velocity at which default misregistration correction is performed (the first sheet linear velocity) can be arbitrarily changed. For example, when a sheet linear velocity corresponding to a sheet used in the first printing after the start-up of the image forming apparatus 100 is the "medium speed", the "medium speed" corresponds to the "first sheet linear velocity" in claims, and the other "first speed" and "low speed" correspond to the "second sheet linear velocity" in claims. Furthermore, the number and types of sheet linear velocities that the image forming apparatus 100 has are optional, and are not limited to those described in the embodiment.

(3) Modification 3

For example, an organic EL head or an LD array can be used instead of the LEDA head 11. In short, the "exposure unit" in claims can include an LEDA head, or can include an organic EL head or an LD array. The point is that the "exposure unit" in claims just has to be configured to implement a function of performing exposure depending on image data, thereby forming a latent image based on the image data on a photoreceptor.

Incidentally, the program executed by the image forming apparatus 100 according to the embodiment (the program executed by the CPU of the control unit 30) can be stored in a computer-readable recording medium, such as a CD-ROM, a flexible disk (FD), a CD-R, or a digital versatile disk (DVD), in an installable or executable file format, and the recording medium can be provided.

Furthermore, the program executed by the image forming apparatus 100 can be stored on a computer connected to a network such as the Internet, and the program can be provided by causing a user to download it via the network. Moreover, the program executed by the image forming apparatus 100 can be provided or distributed via a network such as the Internet.

According to the present invention, it is possible to suppress deterioration of the image quality while suppressing the user down-time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an exposure unit configured to perform exposure depending on image data thereby forming a latent image based on the image data on a photoreceptor;

a sheet-linear-velocity setting unit configured to variably set, according to a type of a sheet used in printing, a sheet linear velocity indicating speed at which the sheet is conveyed;

an image-formation-rate changing unit configured to change, according to the sheet linear velocity set by the sheet-linear-velocity setting unit, an image formation rate indicating a cycle of image formation of the exposure unit;

a detecting unit configured to detect a misregistration correction pattern image formed on an image carrier driven at predetermined speed;

a first correcting unit configured to correct, when printing is performed with a first sheet linear velocity indicating a reference sheet linear velocity, misregistration according to a result of detection of the misregistration correction pattern image by the detecting unit; and a second correcting unit configured to correct, when the sheet-linear-velocity setting unit sets a second sheet linear velocity indicating a sheet linear velocity other than the first sheet linear velocity, an adjustment amount which has been used in the misregistration correction performed by the first correcting unit, according to a ratio between a first coefficient and a second coefficient, the first coefficient indicating a ratio of an actual image formation rate at the first sheet linear velocity to an ideal image formation rate, and the second coefficient indicating a ratio of an actual image formation rate at the second sheet linear velocity to an ideal image formation rate.

2. The image forming apparatus according to claim 1, wherein the adjustment amount indicates an amount of delay in exposure timing of the exposure unit, and the second correcting unit corrects the adjustment amount by multiplying the adjustment amount by a value of the ratio between the first coefficient and the second coefficient to delay the exposure timing in accordance with the corrected adjustment amount.

3. The image forming apparatus according to claim 2, wherein the adjustment amount is expressed as a line number indicating the cycle of image formation of the exposure unit, and the second correcting unit includes:

a first delay unit configured to perform control of delaying the exposure timing by an amount of time corresponding to an integer part of the line number expressing the corrected adjustment amount; and a second delay unit configured to perform control of delaying the exposure timing by an amount of time corresponding to a clock number obtained by multiplying the number of clocks indicating the actual image formation rate at the second sheet linear velocity by a fractional part of the line number expressing the corrected adjustment amount.

4. The image forming apparatus according to claim 2, wherein the adjustment amount is expressed as a line number indicating the cycle of image formation of the exposure unit, and the second correcting unit includes:

a first delay unit configured to perform control of delaying the exposure timing by an amount of time corresponding to an integer part of the line number expressing the corrected adjustment amount; and a second delay unit configured to set a fractional part of the line number expressing the corrected adjustment amount to a fixed value, and perform control of delaying the exposure timing in accordance with the set fixed value.

5. The image forming apparatus according to claim 4, wherein the fixed value is the smallest value within a settable range.

6. The image forming apparatus according to claim 1, wherein the first and second coefficients are each a significant figure having at least significant digits of the adjustment amount.

7. The image forming apparatus according to claim 1, wherein the first sheet linear velocity is the highest in preset multiple sheet linear velocities.

8. The image forming apparatus according to claim 1, further comprising an adjusting unit configured to variably adjust the image formation rate in response to input.

9. The image forming apparatus according to claim 1, wherein the exposure unit includes an LEDA head.

10. The image forming apparatus according to claim 1, wherein the exposure unit includes an organic EL head.

11. The image forming apparatus according to claim 1, wherein the exposure unit includes an LD array.

12. An image forming method comprising:

performing exposure depending on image data thereby forming a latent image based on the image data on a photoreceptor;

variably setting, according to a type of a sheet used in printing, a sheet linear velocity indicating speed at which the sheet is conveyed;

changing, according to the sheet linear velocity set at the setting, an image formation rate indicating a cycle of image formation at the exposing;

detecting a misregistration correction pattern image formed on an image carrier driven at predetermined speed;

correcting, when printing is performed with a first sheet linear velocity indicating a reference sheet linear velocity, misregistration according to a result of detection at the detecting; and correcting, when a second sheet linear velocity indicating a sheet linear velocity other than the first sheet linear velocity is set at the correcting the misregistration, an adjustment amount which has been used in the misregistration correction, according to a ratio between a first coefficient and a second coefficient, the first coefficient indicating a ratio of an actual image formation rate at the first sheet linear velocity to an ideal image formation rate, and the second coefficient indicating a ratio of an actual image formation rate at the second sheet linear velocity to an ideal image formation rate.

* * * * *